US008326186B2

(12) United States Patent
Hayashi

(10) Patent No.: US 8,326,186 B2
(45) Date of Patent: Dec. 4, 2012

(54) DEVELOPING DEVICE AND IMAGE FORMING APPARATUS USING THE SAME

(75) Inventor: Shigeki Hayashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 323 days.

(21) Appl. No.: 12/858,608

(22) Filed: Aug. 18, 2010

(65) Prior Publication Data

US 2011/0058854 A1 Mar. 10, 2011

(30) Foreign Application Priority Data

Sep. 4, 2009 (JP) ..... 2009-204316

(51) Int. Cl.
*G03G 15/08* (2006.01)

(52) U.S. Cl. ..... 399/254; 399/119; 399/262

(58) Field of Classification Search ..... 399/119, 399/222, 258, 262
See application file for complete search history.

(56) References Cited

U.S. PATENT DOCUMENTS

| | | | | |
|---|---|---|---|---|
| 6,317,576 | B1 * | 11/2001 | Ishida et al. | 399/273 |
| 2010/0028052 | A1 * | 2/2010 | Akedo | 399/254 |
| 2010/0074655 | A1 * | 3/2010 | Morimoto | 399/254 |

FOREIGN PATENT DOCUMENTS

| | | | |
|---|---|---|---|
| JP | 10-63081 | A | 3/1998 |
| JP | 2006-98882 | A | 4/2006 |
| JP | 2007-322719 | A | 12/2007 |

* cited by examiner

*Primary Examiner* — David Gray
*Assistant Examiner* — G. M. Hyder
(74) *Attorney, Agent, or Firm* — Nixon & Vanderhye, P.C.

(57) ABSTRACT

A developing device includes: a developing vessel for storing a developer containing a toner and a magnetic carrier; a first conveying passage through which the developer is conveyed approximately horizontally; and a toner supply port for leading toner to the first conveying passage. The toner supply port is formed over the first conveying passage. The developing device includes a multiple number of electromagnets that intermittently attract and release the developer, over the first conveying passage. At the same time, a multiple number of downward slopes that go down toward the downstream side with respect to the developer conveying direction are formed in the bottom of the first conveying passage in areas in which the developer that has been attracted to the electromagnets and is released from the electromagnets falls.

8 Claims, 7 Drawing Sheets

DEVELOPING DEVICE AND IMAGE FORMING APPARATUS USING THE SAME

This Nonprovisional application claims priority under 35 U.S.C. §119(a) on Patent Application No. 2009-204316 filed in Japan on 4 Sep. 2009, the entire contents of which are hereby incorporated by reference.

BACKGROUND OF THE INVENTION (1) Field of the Invention

The present invention relates to a developing device and an image forming apparatus using the device, in particular relating to a developing device using a dual-component developer containing a toner and a magnetic carrier, for use in an image forming apparatus for forming images with the toner based on electrophotography, such as an electrostatic copier, laser printer, facsimile machine or the like, as well as to an image forming apparatus using this device.

(2) Description of the Prior Art

Conventionally, image forming apparatuses based on electrophotography such as copiers, printers, facsimile machines and the like have been known. The image forming apparatus based on electrophotography is constructed so as to form an image by forming an electrostatic latent image on the photoreceptor drum (toner image bearer) surface, supplying toner to the photoreceptor drum from a developing device to develop the electrostatic latent image, transferring the toner image formed on photoreceptor drum by development to a sheet of paper or the like, and fixing the toner image onto the sheet by means of a fixing device.

Recently, in the image forming apparatuses capable of reproducing full-color and high-quality images, a dual-component developer (which will be referred to hereinbelow as simply "developer"), which enables the toner to present excellent charge performance stability, is often used.

This developer consists of a toner and a carrier, which are agitated in the developing device and frictionally rubbed with each other so as to produce appropriately electrified toner.

In the developing device, the electrified toner is supplied to a developer supporting member, e.g., the surface of a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

Further, the image forming apparatus of this kind is demanded to be made compact and operate at high speeds, it is hence necessary to electrify the developer quickly and sufficiently and also convey the developer quickly and smoothly.

To deal with such demands, a developing device of a circulating mechanism has been adopted in the image forming apparatus in order to disperse added toner promptly into the developer and provide the toner with a suitable amount of static charge. This circulating type developing device includes a developer conveying passage through which the developer is circulatively conveyed and a developer conveying member that conveys the developer while agitating the developer in the developer passage (see Patent Document 1: Japanese Patent Application Laid-open H10-63081)

In this circulating type developing device, when the toner concentration in the developer in the developing device becomes lower than a predetermined level, toner is added from the toner hopper to the developer conveying passage.

However, since the conventional circulative type developing device conveys the developer whilst mixing (agitating) the added toner with the existing developer, if the agitating force is low there occurs the problem that the toner is conveyed to the developer roller without gaining a sufficient amount of static charge.

On the other hand, if the performance of agitating the developer and toner is enhanced by providing mesh-like screen members or arranging many parts such agitating paddles etc., there occurs the problem that the developer receives much stress and hence is lowered in durability.

Particularly, for a developer containing micro-sized carrier and a micro-sized toner, if the agitating force is enhanced, toner fluidity enhancer particles (external additive) become embedded into the toner surface due to stress, and the fluidity of the developer lowers extremely, making it difficult to convey the developer. As a result, the necessary amount of toner cannot be supplied to the photoreceptor drum surface, causing a problem of the image density being lowered.

Further, since, in the developing device in which the developer is conveyed as being agitated, the specific gravity of the developer (carrier) is very high (about three times) relative to the specific gravity of the added toner, it is difficult for the added toner to fall down into the bottom of the developer. As a result, there occurs the problem that the toner is conveyed to the developer roller without gaining a sufficient amount of static charge. If the agitation performance is enhanced by use of agitating paddles, the mixing performance (static charge performance) may be improved but there occurs the problem that the fluidity of the developer becomes markedly lowered due to stress from agitation.

SUMMARY OF THE INVENTION

The present invention has been devised in view of the above problems, it is therefore an object of the present invention to provide a developing device that includes a developer conveying passage in which a developer is conveyed in a predetermined direction and can prevent occurrence of insufficient image density by preventing toner that bears an insufficient amount of static charge from being conveyed and supplied to a developing roller and lowering stress acting on the developer during agitation and conveyance, as well as providing an image forming apparatus using this developing device.

According to the present invention, the developing device for solving the above problems and the image forming apparatus using this are configured as follows:

The first aspect of the present invention resides in a developing device comprising: a developer container for storing a developer comprising a toner and a magnetic carrier; a developer conveying passage through which the developer is conveyed approximately horizontally; and, a toner supply port for leading the toner to the developer conveying passage, and is characterized in that the toner supply port is formed over the developer conveying passage, an electromagnet that intermittently attracts and releases the developer is provided over the developer conveying passage, and a downward slope that goes down toward the downstream side with respect to the developer conveying direction is formed in the bottom of the developer conveying passage in an area on which the developer attracted by the electromagnet falls after it is released.

The second aspect of the present invention is characterized in that a plurality of the electromagnets and a plurality of the downward slopes are provided along the developer conveying direction.

The third aspect of the present invention is characterized in that an upward slope that goes up toward the downstream side with respect to the developer conveying direction (or that goes down from the downward slope toward upstream side with respect to the developer conveying direction) is formed in the bottom of the developer conveying passage on the upstream side, with respect to the developer conveying direction, of the downward slope, and the inclined angle of the upward slope is formed to be greater than the inclined angle of the downward slope.

The fourth aspect of the present invention is characterized in that the inclined angle of the upward slope is set at 90 degrees.

The fifth aspect of the present invention is characterized in that, with regard to the plural electromagnets, among the neighboring electromagnets, the electromagnet that is located on the upstream side with respect to the developer conveying direction releases the developer that has been attracted thereto when the electromagnet that is located on the downstream side with respect to the developer conveying direction attracts the developer.

The sixth aspect of the present invention resides in an image forming apparatus for forming images with toner based on electrophotography, comprising: a photoreceptor drum having the surface on which an electrostatic latent image is formed; a charging device for electrifying the surface of the photoreceptor drum; an exposure device for forming an electrostatic latent image on the photoreceptor drum surface; a developing device for forming a toner image by supplying toner to the electrostatic latent image on the photoreceptor drum surface; a transfer device for transferring the toner image on the photoreceptor drum surface to a recording medium; and, a fixing device for fixing the toner image to the recording medium, and is characterized in that the developing device employs any one of the developing devices having the above first to fifth aspects.

According to the developing device of the first aspect of the present invention, when the developer attracted to the electromagnet is released, the falling developer flows along the downward slope in the bottom of the developer conveying passage toward the downstream side with respect to the developer conveying direction. Accordingly, it is possible to convey the developer in the developer conveying direction while making the developer move up and down (making an up-and-down movement) by repeating alternate attractions of developer to and release of the developer from the electromagnet. As a result, it is possible to quickly mix added toner with the developer without causing excessive stress on the developer. With this configuration, it is possible to convey the toner bearing a sufficient amount of static charge to the developing roller, hence prevent occurrence of insufficient image density.

According to the developing device of the second aspect of the present invention, since the developer's up-and-down movement made by attractions to and release from the electromagnets can be positively carried out as many times as the number of the electromagnets and downward slopes, it is possible to prevent the added toner from being conveyed without gaining a sufficient amount of static charge.

According to the developing device of the third aspect of the present invention, when the developer that was once attracted to, and has been released from the electromagnets flows over the downward slopes in the bottom of the developer conveying passage toward the downstream side with respect to the developer conveying direction, part of the developer can be positively stopped by the upward slopes. Accordingly, it is possible to move the developer up and down at least as many times as the number of the electromagnets and downward slopes, hence prevent the added toner from being conveyed without gaining a sufficient amount of static charge. Further, since the inclined angle of the upward slopes is set greater than the inclined angle of the downward slopes, the horizontal distance of the downward slopes is longer that that of the upward slopes. Accordingly, it is possible to make lower the amount of developer moving in the reverse direction to the developer conveying direction.

According to the developing device of the fourth aspect of the present invention, it is possible to make the lowest the amount of developer moving in the reverse direction to the developer conveying direction.

According to the developing device of the fifth aspect of the present invention, since the developer on the downstream side with respect to the developer conveying direction is being attracted upward by the electromagnet on the downstream side, the developer on the upstream side when it is released can be conveyed along the downward slope in the developer conveying passage without being disturbed by the developer on the upstream side. Accordingly, it is possible to efficiently convey the developer.

Finally, according to the sixth aspect of the present invention, since the added toner and the existing developer can be agitated and conveyed without causing excessive stress on the developer, it is possible to prevent the developer from being worn out. As a result it is possible to produce excellent images without causing toner scattering and image fogging due to insufficient charge of the added toner.

DESCRIPTION OF THE PREFERRED EMBODIMENTS

Now, the embodied mode for carrying out the present invention will be described with reference to the drawings.

Figure 1:
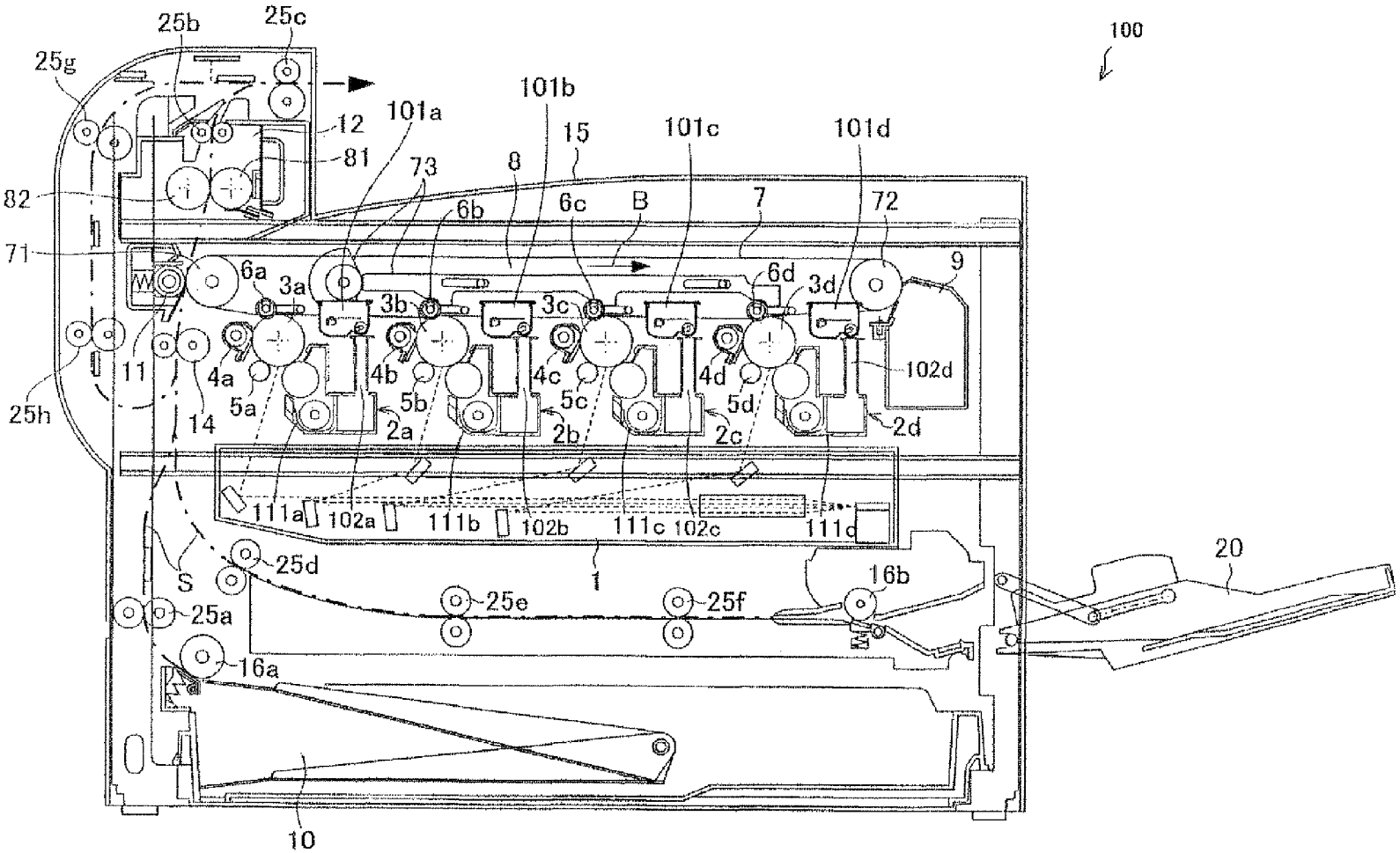
FIG. 1 is an illustrative view showing the overall configuration of an image forming apparatus including a developing device according to the embodiment of the present invention.

FIG. 1 shows one exemplary embodiment of the present invention, and is an illustrative view showing the overall configuration of an image forming apparatus including a developing device according to the embodiment of the present invention.

An image forming apparatus 100 of the present embodiment forms an image with toners based on electrophotography, including: as shown in FIG. 1, photoreceptor drums 3*a*, 3*b*, 3*c* and 3*d* (which may be also called "photoreceptor drums 3" when general mention is made) for forming electrostatic latent images on the surfaces thereof; chargers (charging devices) 5*a*, 5*b*, 5*c* and 5*d* (which may be also called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may be also called "developing devices 2" when general mention is made) for supplying toners to the electrostatic latent images on the photoreceptor drum 3 surfaces to form toner images; toner hoppers (toner supply devices) 101*a*, 101*b*, 101*c* and 101*d* (which may be also called "toner hoppers 101" when general mention is made) for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium.

This image forming apparatus 100 forms a multi-color or monochrome image on a predetermined sheet (recording paper, recording medium) in accordance with image data transmitted from the outside. Here, image forming apparatus 100 may also include a scanner or the like on the top thereof.

To being with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimpose these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4*a*, 4*b*, 4*c* and 4*d* (which may also be called "cleaner units 4 when general mention is made) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 includes exposure unit 1, fixing unit 12, a sheet conveyor system S and a paper feed tray 10 and a paper output tray 15.

Charger 5 uniformly electrifies the photoreceptor drum 3 surface at a predetermined potential.

As charger 5, other than the contact roller-type charger shown in FIG. 1, a contact brush-type charger, a non-contact type discharging type charger and others may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may also be used as exposure unit 1. Exposure unit 1 illuminates the photoreceptor drums 3 that have been electrified, in accordance with input image data so as to form electrostatic latent images corresponding to the image data on the surfaces of photoreceptor drums 3.

Developing device 2 visualizes (develops) the electrostatic latent image formed on photoreceptor drum 3 with toner of K, C, M or Y. Developing devices 2 (2*a*, 2*b*, 2*c* and 2*d*) include toner hoppers 101 (101*a*, 101*b*, 101*c* and 101*d*), toner transport mechanisms 102*a*, 102*b*, 102*c* and 102*d* (which may also be called "toner transport mechanisms 102 when general mention is made) and developing vessels (developer containers) 111*a*, 111*b*, 111*c* and 111*d* (which may also be called "developer vessels 111 when general mention is made).

Toner hopper 101 is arranged on the upper side of developing vessel 111 and stores unused toner (powdery toner). The toner is supplied from toner hopper 101 to developing vessel 111 by means of toner transport mechanism 102.

Cleaner unit 4 removes and collects the toner remaining on the photoreceptor drum 3 surface after development and image transfer steps.

Arranged over photoreceptor drums 3 is an intermediate transfer belt unit 8. Intermediate transfer belt unit 8 includes intermediate transfer rollers 6*a*, 6*b*, 6*c* and 6*d* (which may also be called "intermediate transfer rollers 6 when general mention is made), an intermediate transfer belt 7, an intermediate transfer belt drive roller 71, an intermediate transfer belt driven roller 72, an intermediate transfer belt tensioning mechanism 73 and, an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 and circulatively drives intermediate transfer belt 7 in the direction of an arrow B in FIG. 1.

Intermediate transfer rollers 6 are rotatably supported at intermediate transfer roller fitting portions in intermediate transfer belt tensioning mechanism 73. Applied to each intermediate transfer roller 6 is a transfer bias for transferring the toner image from photoreceptor drum 3 to intermediate transfer belt 7.

Intermediate transfer belt 7 is arranged so as to be put in contact with each photoreceptor drum 3. The toner images of different color components formed on photoreceptor drums 3 are successively transferred one over another to intermediate transfer belt 7 so as to form a full-color toner image (multi-color toner image). This intermediate transfer belt 7 is formed of an endless film of about 100 to 150 μm thick, for instance.

Transfer of the toner image from photoreceptor drum 3 to intermediate transfer belt 7 is performed by intermediate transfer roller 6 which is in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc.) coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in their place.

The electrostatic latent image formed on each of photoreceptor drums 3 is developed as described above with the toner associated with its color component into a visual toner image. These toner images are laminated on intermediate transfer belt 7, laying one image over another. The thus formed lamination of toner images is moved by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner age to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Of the toner adhering to intermediate transfer belt 7 as the belt comes in contact with photoreceptor drums 3, the toner which has not been transferred from intermediate transfer belt 7 to the paper during transfer of the toner image and remains on intermediate transfer belt 7 would cause contamination of color toners at the next operation, hence is removed, and collected by an intermediate transfer belt cleaning unit 9.

Intermediate transfer belt cleaning unit 9 includes a cleaning blade (cleaning member) that comes into contact with intermediate transfer belt 7. Intermediate transfer belt 7 is supported from its interior side by intermediate transfer belt driven roller 72, at the area where this cleaning blade comes into contact with intermediate transfer belt 7.

Paper feed tray 10 is to stack sheets (e.g., recording paper) to be used for image forming and is disposed under the image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and transfer roller 11.

Arranged along sheet conveyor system S are pickup rollers 16*a* and 16*b* (which may be also called "pickup rollers 16" when general mention is made), a registration roller 14, the transfer portion, fixing unit 12 and feed rollers 25*a* to 25*h* (which may be also called "feed rollers 25" when general mention is made) and the like.

Feed rollers 25 are a plurality of small-diametric rollers arranged along sheet conveyor system S to promote and assist sheet conveyance. Pickup roller 16*a* is a roller disposed at the end of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end of the image area on intermediate transfer belt 7.

Fixing unit 12 includes a heat roller 81, a pressing roller 82 and the like. These heat roller 81 and pressing roller 82 rotate while nipping the sheet therebetween. Heat roller 81 is controlled by a controller (not shown) so as to keep a predetermined fixing temperature. This controller controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. The sheet with a multi-color toner image (a single color toner image) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 is equipped with paper feed, tray 10 that stacks sheets beforehand and manual feed tray 20 that is used when a few pages are printed out. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the image area including a lamination of toner images on intermediate transfer belt 7. At the transfer portion, the toner image is transferred onto the sheet. Then, this toner image is fixed onto the sheet by fixing unit 12. Thereafter, the sheet passes through feed roller 25*b* to be discharged by paper output roller 25*c* onto paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet which has been printed on the first side and passed through fixing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, developing device 2 will be described with reference to the drawings.

Figure 2:
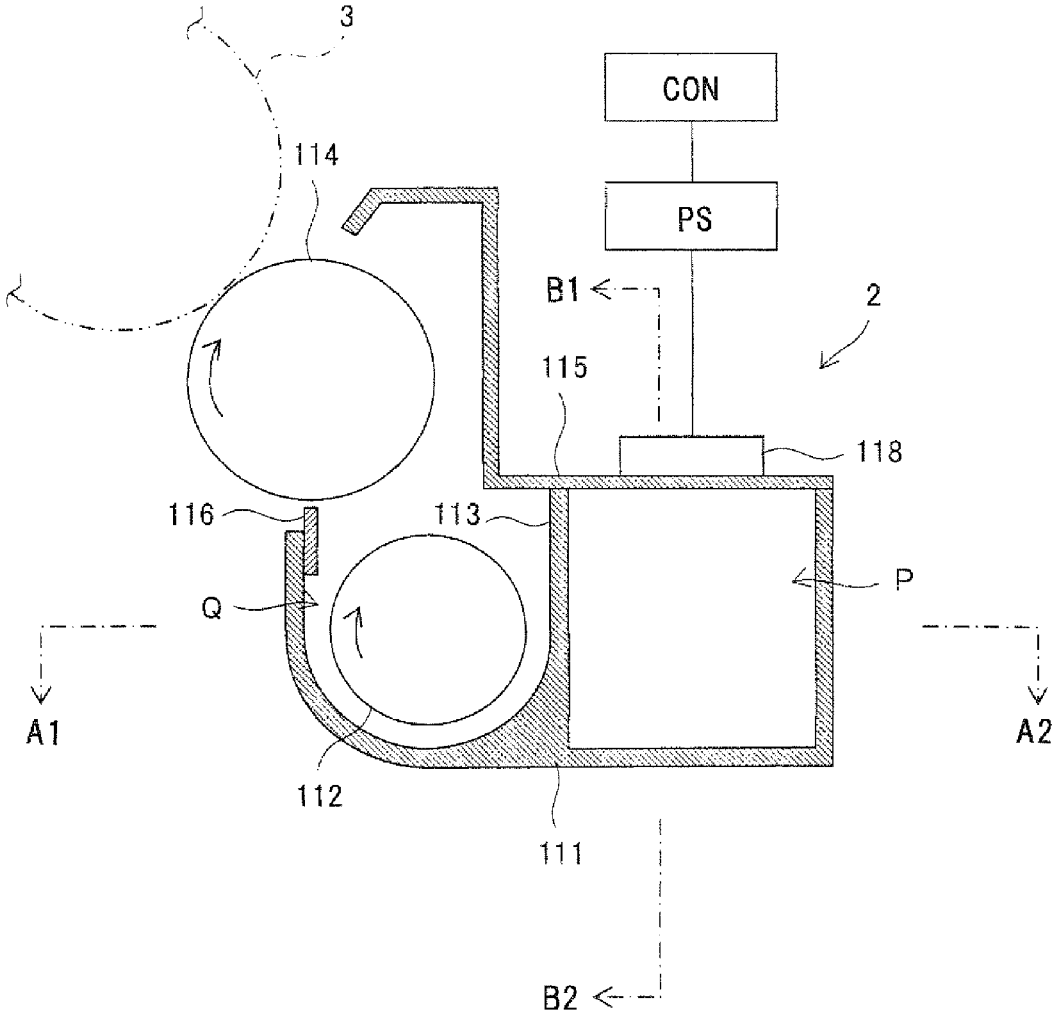
FIG. 2 is a sectional view showing the configuration of the developing device for the image forming apparatus.
Figure 3:
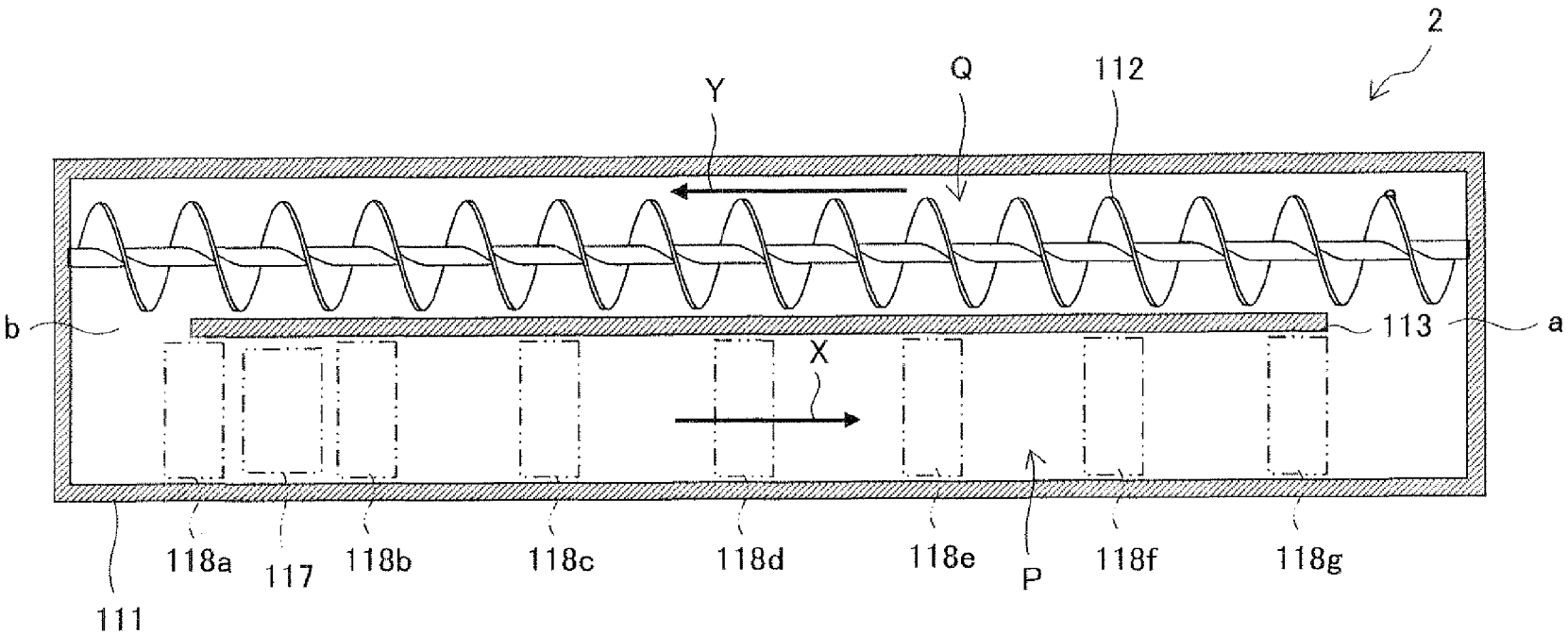
FIG. 3 is a sectional view cut along a plane A1-A2 in FIG. 2.
Figure 4:
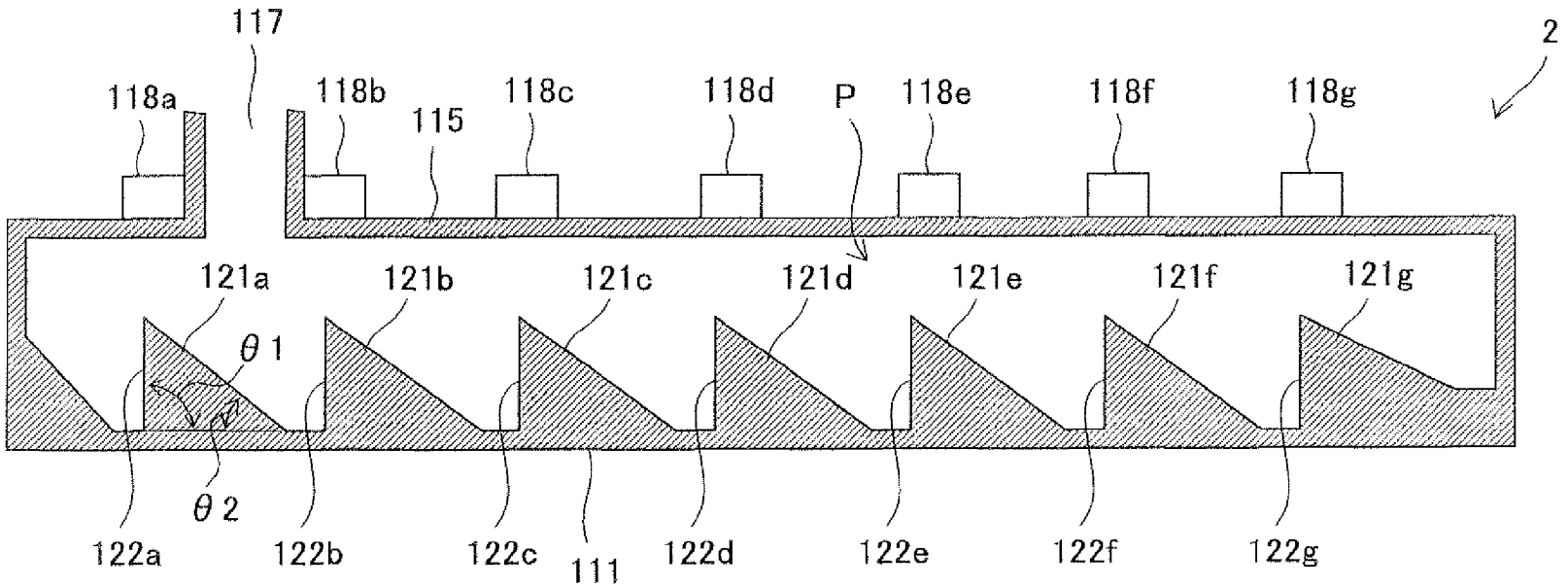
FIG. 4 is a sectional view cut along a plane B1-B2 in FIG. 2.

FIG. 2 is a sectional view showing the configuration of the developing device for the image forming apparatus according to the present embodiment, FIG. 3 is a sectional view cut along a plane A1-A2 in FIG. 2, and FIG. 4 is a sectional view cut along a plane B1-B2 in FIG. 2.

As shown in FIG. 2, developing device 2 has a developing roller 114 arranged in developing vessel 111 so as to oppose photoreceptor drum 3 and supplies toner from developing roller 114 to the photoreceptor drum 3 surface to visualize (develop) the electrostatic latent image formed on the surface of photoreceptor drum 3.

As shown in FIGS. 2 to 4, developing device 2, other than developing roller 114, further includes developing vessel 111, a developing vessel cover 115, a toner supply port 117 (FIGS. 3 and 4), a doctor blade 116, a developer conveying member 112, a partitioning plate (partitioning wall) 113 and a plurality of electromagnets 118.

Developing vessel 111 is a receptacle for holding a developer (dual-component developer) that contains a toner and a carrier. Developing vessel 111 includes developing roller 114, developer conveying member 112 and the like. Here, the carrier of the present embodiment is a magnetic carrier presenting magnetism.

Developing roller 114 is a rotating magnet roller which draws up and carries the developer in developing vessel 111 on the surface thereof and supplies toner from the developer supported on the surface thereof to photoreceptor drum 3. A doctor blade (layer thickness limiting blade) 116 is arranged close to the surface of developing roller 114.

Arranged on the top of developing vessel 111 is removable developing vessel cover 115, as shown in FIGS. 2 and 4. This developing vessel cover 115 has toner supply port 117 for leading unused toner into developing vessel 111, as shown in FIG. 4.

In this arrangement, as shown in FIG. 1, the toner stored in toner hopper 101 is transported into developing vessel 111 through toner transport mechanism 102 and toner supply port 117, and thereby supplied to developing vessel 111.

As shown in FIGS. 2 and 3, developer conveying member 112 is composed of an auger screw having a helical blade for agitating and conveying the developer in developing vessel 111, and rotationally driven by a drive means (not shown) such as a motor etc., to agitate and convey the developer.

Partitioning plate 113 is extended parallel to the axial direction of developer conveying member 112, as shown in FIG. 3. The interior of developing vessel 111 is divided by this partitioning plate 113 into two sections, namely, a first conveying passage (developer conveying passage) P having toner supply port 117 and a second conveying passage (developer conveying passage) Q in which developer conveying member 112 is disposed.

In first conveying passage P the developer is conveyed in the direction of arrow X by the function of aftermentioned electromagnets 118 while in the second conveying passage Q the developer is conveyed in the direction of arrow Y by developer conveying member 112.

Further, communication paths that connect between first conveying passage P and second conveying passage Q are formed at both ends of partitioning plate 113. In the following description, the communication path formed on the downstream side with respect to the direction of arrow X is named first communicating path a and the communicating path formed on the downstream side with respect to the direction of arrow Y is named second communicating path b, as shown in FIG. 3.

Toner supply port 117 is formed at a position over, and within first conveying passage P, downstream of second communicating path b with respect to the direction of arrow X. That is, toner is supplied into first conveying passage P at a position downstream, with respect to the developer conveying direction, of second communicating path b.

As shown in FIGS. 3 and 4, seven electromagnets 118, namely electromagnets 118*a*-118*g* are arranged on the top (outside) of developer vessel cover 115 over first conveying passage P, so as to attract the developer in first conveying passage P to the underside (inside) of developer vessel cover 115.

Electromagnet 118*a* is arranged upstream of toner supply port 117 with respect to the developer conveying direction while the other electromagnets 118*b* to 118*g* are arranged at intervals of a predetermined distance downstream with respect to the developer conveying direction. Each electromagnet is connected to a power source PS (FIG. 2).

In the present embodiment, operation control is performed such that all the electromagnets 118*a*-118*g* are energized at the same time, based on the control signal from a controller CON (FIG. 2).

In the bottom of first conveying passage P, seven downward slopes 121*a*-121*g* that go down toward the downstream side with respect to the developer conveying direction are formed vertically under the seven electromagnets 118*a*-118*g* arranged over and above first conveying passage P, or at the positions opposing electromagnets 118*a*-118*g*, respectively.

Formed on the upstream of downward slopes 121*a*-121*g* with respect to the developer conveying direction are upward slopes 122*a*-122*g* that go up toward the downstream side with respect to the developer conveying direction. In the present embodiment, the inclined angle θ1 of upward slopes 122*a*-122*g* is designated at 90 degrees (vertical) with respect to the horizontal plane.

As electromagnets 118*a*-118*g* are energized, the developer in first conveying passage P is attracted locally to each of electromagnets 118*a*-118*g*. Then, when electromagnets 118*a*-118*g* are deactivated, the developer is released and falls.

At this moment, part of the falling developer falls over downward slopes 121*a*-121*g*. The developer that fell over downward slopes 121*a*-121*g* is conveyed in the direction of arrow X (FIG. 3) sliding down along downward slopes 121*a*-121*g*.

In first conveying passage P, the developer is conveyed in the direction of arrow X as moving up and down by repeatedly energizing and de-energizing electromagnets 118*a*-118*g* and reaches first communication path a. The developer reaching first communication path a is conveyed through first communication path a to second conveying passage Q.

In second conveying passage Q, the developer is agitated and conveyed in the direction of arrow Y by developer conveying member 112 to reach second communication path b. Then, the developer reaching second communication path b is conveyed through second communication path b to first conveying passage P.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed, in second conveying passage Q, and the toner in the drawn up developer is continuously consumed as transferring to photoreceptor drum 3.

In order to compensate for this consumption of toner, unused toner is supplied from toner supply port 117 into first conveying passage P. The supplied toner has to be agitated and mixed with the previously existing dual-component developer in the first conveying passage P.

Here in the above embodiment, operation control is performed such that all electromagnets 118*a*-118*g* are energized from power source PS at the same time, based on the control signal from a controller CON (FIG. 2). However, it is possible to perform operation control intermittently such that the activation/cutoff (deactivation) times of electromagnet 118*a*, electromagnet 118*b*, electromagnet 118*c*, electromagnet 118*d*, electromagnet 118*e*, electromagnet 118*f* and electromagnet 118*g* are delayed from one to another in the order mentioned. This operation control of electromagnets 118*a*-118*g* makes it possible to efficiently convey the developer that has fallen over the downward slopes 121*a*-121*g*, in the direction arrow X along the downward slopes 121*a*-121*g*.

As a specific way of control, the energizing time and cutoff time of electromagnets 118*a*-118*g* may be set at 0.3 sec. and 0.5 sec., respectively, and the activation times may be delayed 0.2 sec. from one to another.

Next, the operation of agitation and conveyance of the developer in developing vessel 111 of developing device 2 will be described with reference to the drawings.

Figure 5:
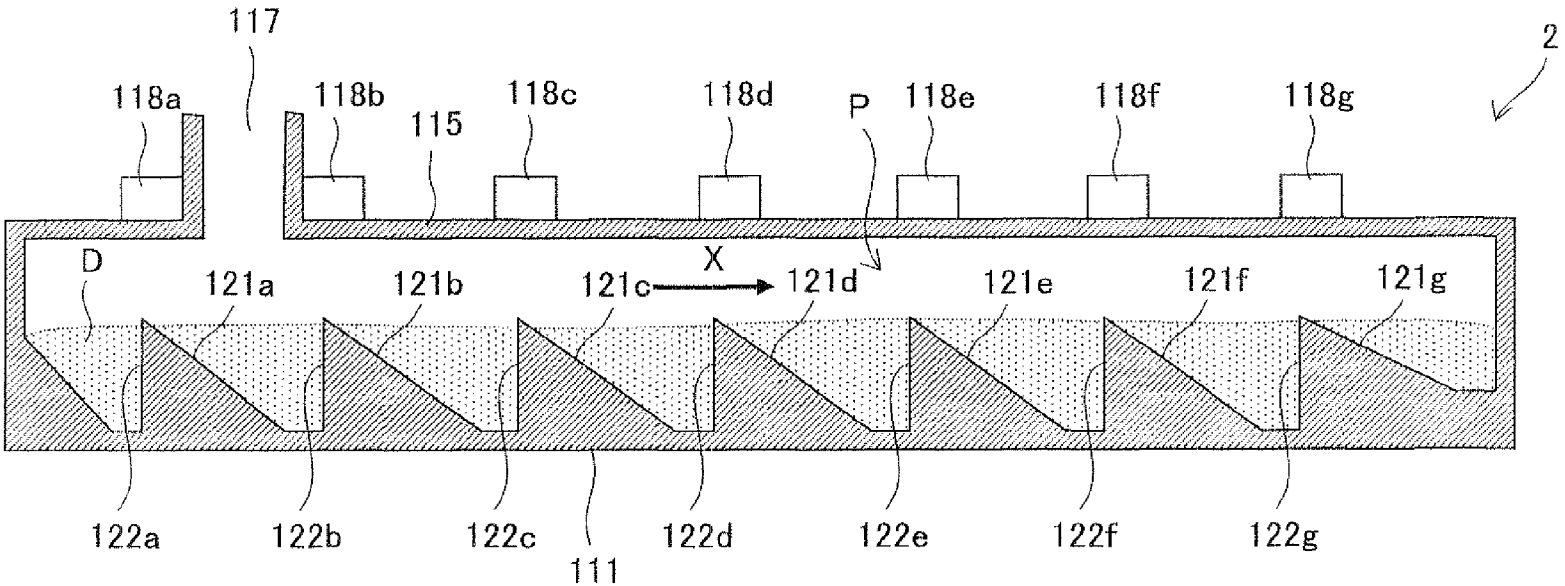
FIG. 5 is an illustrative view showing the state of the developer in the first conveying passage of the developing vessel when electromagnets of a developing device are not energized (is cut off)
Figure 6:
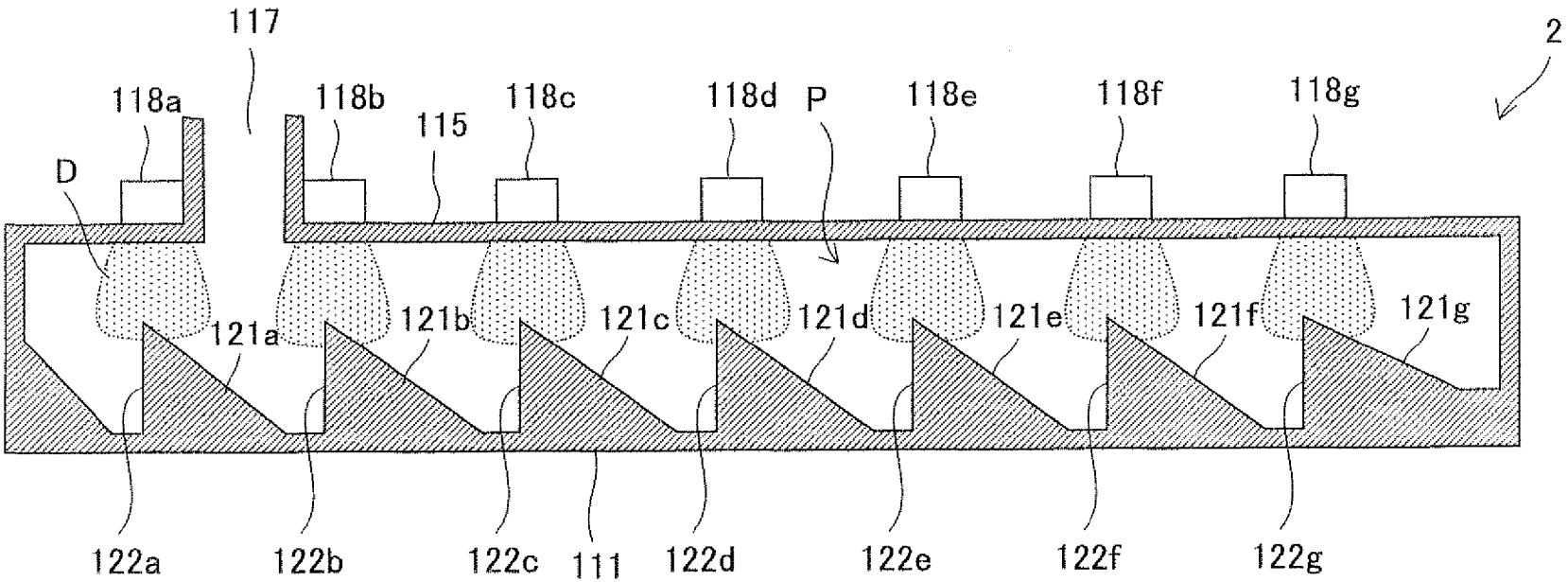
FIG. 6 is an illustrative view showing the state where the developer has been attracted to the electromagnets when the electromagnets are energized; and, FIG. 7 is an illustrative view showing the state where the developer that was attracted to the electromagnets has fallen off the electromagnets when power to the electromagnets is cut off.
Figure 7:
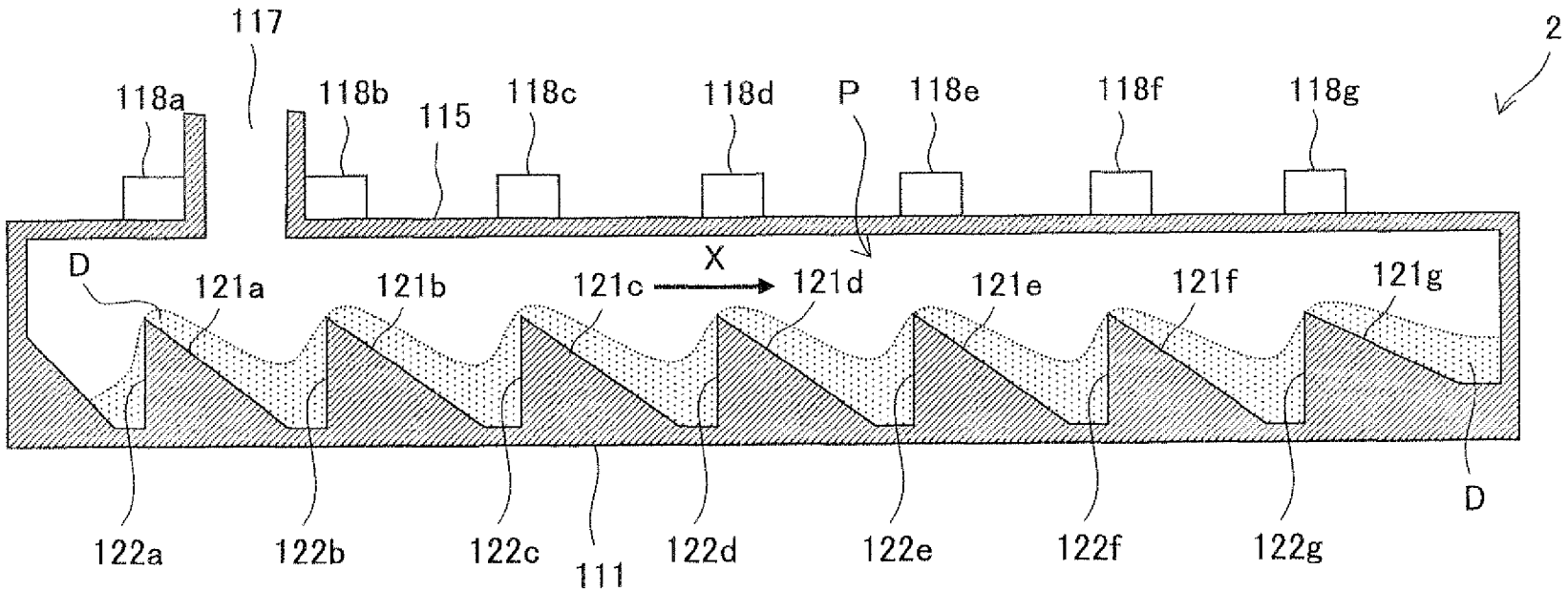

FIGS. 5 to 7 are schematic diagrams showing how the developer is conveyed by the electromagnets, making up-and-down movement inside the developer vessel of the developing device according to the present embodiment. FIG. 5 is an illustrative view showing the state of the developer inside the first conveying passage of the developing vessel when the electromagnets of the developing device are not energized (is cutoff); FIG. 6 is an illustrative view showing the state where the developer has been attracted to the electromagnets when the electromagnets are energized; and, FIG. 7 is an illustrative view showing the state where the developer that was attracted to the electromagnets has fallen off the electromagnets when power to the electromagnets are cut off.

In developing device 2, when no current flows through electromagnets 118*a*-118*g* (in the cutoff state), developer D inside first conveying passage P of developing vessel 111 is spread out in the bottom of first conveying passage P, as shown in FIG. 5.

When electromagnets 118*a*-118*g* are energized, developer D in first conveying passage P is attracted to electromagnets 118*a*-118*g* by magnetic force, and locally collected to the underside of each of electromagnets 118*a*-118*g*.

Then, as power to electromagnets 118*a*-118*g* is cut off, immediately after power deactivation (in the initial state of cutoff) part of developer D of the developer D that has fallen off electromagnets 118*a*-118*g* moves down in the developer conveying direction (in the direction of arrow X) along the downward slopes 121*a*-121*g* while the remaining part of developer D falls along upward slopes 122*a*-122*g* and stays in the bottom of first conveying passage P, as shown in FIG. 7. Thereafter, the developer D that has fallen moves to return to the state as shown in FIG. 5, due to developer's fluidity.

In this way, alternate attractions of developer D to electromagnets 118*a*-118*g* and release from the electromagnets make it possible to convey the developer D in the developer conveying direction (in the direction of arrow X) as making developer D move up and down (making an up-and-down movement).

According to the present embodiment having the above configuration, provision of multiple electromagnets 118*a*-118*g* over and above first conveying passage P and provision of downward slopes 121*a*-121*g* in the bottom of first conveying passage P at the positions opposing electromagnets 118*a*-118*g*, makes it possible to move the developer D up and down by the magnetic force of electromagnets 118*a*-118*g* so as to agitate developer D without applying excessive pressure and make developer D fall along downward slopes 121*a*-121*g*, to thereby convey the developer without applying heavy stress.

Thus, according to the present embodiment, it is possible to convey the toner that bears a sufficient amount of static charge, to developing roller 114, hence it is possible to inhibit the image density from being lowered and produce high-quality images in a stable manner.

Further, according to the present embodiment, since multiple electromagnets 118*a*-118*g* and multiple downward slopes 121*a*-121*g* are provided, the developer's up-and-down movement made by attractions to and release from electromagnets 118*a*-118*g* can be positively carried out as many times as the number of the electromagnets and downward slopes. It is hence possible to tribe-electrify the added toner, adequately.

Further, according to the present embodiment, since upward slopes 122*a*-122*g* are contiguously formed, on the upstream side, with respect to the developer conveying direction, of downward slopes 121*a*-121*g* and the inclined angle θ1 of upward slopes 122*a*-122*g* is set at 90 degrees, part of the developer D falling after release from its attraction to electromagnets 118*a*-118*g* can be positively stopped by upward slopes 122*a*-122*g* when the developer flows downstream with respect to the developer conveying direction over the downward slopes 121*a*-121*g*. Accordingly, it is possible to move the developer up and down at least as many times as the number of electromagnets 118*a*-118*g* and slopes 121*a*-121*g*, hence prevent the added toner from being conveyed without gaining a sufficient amount of static charge.

Further, the inclined angle θ1 of upward slopes 122*a*-122*g* is set vertical or at 90 degrees with respect to the horizontal plane. That is, the angle θ1 is designated to be greater than the inclined angle θ2 of downward slopes 121*a*-121*g*, so that the horizontal distance of downward slopes 121*a*-121*g* is longer than that of upward slopes 122*a*-122*g*. Accordingly, it is possible to make lower the amount of developer that moves in the reverse direction relative to the developer conveying direction, hence developer D can be positively conveyed in the developer conveying direction (in the direction of arrow X).

Though the above embodiment was described taking an example in which developing device 2 of the present invention is applied to image forming apparatus 100 shown in FIG. 1, as long as it is an image forming apparatus using a developing device in which added toner is conveyed while being agitated, the invention can be developed to any other image forming apparatus and the like, not limited to the image forming apparatus and copier having the configuration described above.

Though the above embodiment was illustrated taking a case including seven electromagnets, seven upward slopes and seven downward slopes, the number is not particularly limited. One or any number of the elements may be provided as long as the aforementioned operation and effect can be achieved.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. A developing device comprising:

a developer container for storing a developer comprising a toner and a magnetic carrier;

a developer conveying passage through which the developer is conveyed approximately horizontally; and, a toner supply port for leading the toner to the developer conveying passage, characterized in that the toner supply port is formed over the developer conveying passage, an electromagnet that intermittently attracts and releases the developer is provided over the developer conveying passage, and a downward slope that goes down toward the downstream side with respect to the developer conveying direction is formed in the bottom of the developer conveying passage in an area on which the developer attracted by the electromagnet falls after it is released.

2. The developing device according to claim 1, wherein a plurality of the electromagnets and a plurality of the downward slopes are provided along the developer conveying direction.

3. The developing device according to claim 2, wherein, with regard to the plural electromagnets, among the neighboring electromagnets, the electromagnet that is located on the upstream side with respect to the developer conveying direction releases the developer that has been attracted thereto when the electromagnet that is located on the downstream side with respect to the developer conveying direction attracts the developer.

4. The developing device according to claim 1, wherein an upward slope that goes up toward the downstream side with respect to the developer conveying direction is formed in the bottom of the developer conveying passage on the upstream side, with respect to the developer conveying direction, of the downward slope, and the inclined angle of the upward slope is formed to be greater than the inclined angle of the downward slope.

5. The developing device according to claim 4, wherein, with regard to the plural electromagnets, among the neighboring electromagnets, the electromagnet that is located on the upstream side with respect to the developer conveying direction releases the developer that has been attracted thereto when the electromagnet that is located on the downstream side with respect to the developer conveying direction attracts the developer.

6. The developing device according to claim 1, wherein the inclined angle of the upward slope is set at 90 degrees.

7. The developing device according to claim 6, wherein, with regard to the plural electromagnets, among the neighboring electromagnets, the electromagnet that is located on the upstream side with respect to the developer conveying direction releases the developer that has been attracted thereto when the electromagnet that is located on the downstream side with respect to the developer conveying direction attracts the developer.

8. An image forming apparatus for forming images with toner based on electrophotography, comprising:

a photoreceptor drum having the surface on which an electrostatic latent image is formed;

a charging device for electrifying the surface of the photoreceptor drum;

an exposure device for forming an electrostatic latent image on the photoreceptor drum surface;

a developing device for forming a toner image by supplying toner to the electrostatic latent image on the photoreceptor drum surface;

a transfer device for transferring the toner image on the photoreceptor drum surface to a recording medium; and, a fixing device for fixing the toner image to the recording medium, characterized in that the developing device employs the developing device defined in claim 1.

* * * * *